US009704623B2

(12) United States Patent
Chen et al.

(10) Patent No.: US 9,704,623 B2
(45) Date of Patent: Jul. 11, 2017

(54) MICRORESISTOR

(71) Applicant: CYNTEC CO., LTD., Hsinchu (TW)

(72) Inventors: Huang-Chou Chen, Hsinchu (TW); Ta-Wen Lo, Hsinchu (TW); Chun-Cheng Yao, Hsinchu (TW)

(73) Assignee: CYNTEC CO., LTD., Hsinchu (TW)

( * ) Notice: Subject to any disclaimer, the term of this patent is extended or adjusted under 35 U.S.C. 154(b) by 49 days.

(21) Appl. No.: 14/864,821

(22) Filed: Sep. 24, 2015

(65) Prior Publication Data

US 2017/0018340 A1 Jan. 19, 2017

(30) Foreign Application Priority Data

Jul. 17, 2015 (TW) ..... 104123186 A

(51) Int. Cl.
*H01C 7/06* (2006.01)
*H01C 1/14* (2006.01)
*H01C 1/01* (2006.01)

(52) U.S. Cl.
CPC ..... *H01C 7/06* (2013.01); *H01C 1/01* (2013.01); *H01C 1/14* (2013.01)

(58) Field of Classification Search
CPC ..... H01C 1/14; H01C 1/01
USPC ..... 338/7, 22 R, 309
See application file for complete search history.

(56) References Cited

U.S. PATENT DOCUMENTS 4,679,056 A * 7/1987 Kobayashi ..... B41J 2/33515 219/504
5,111,179 A * 5/1992 Flassayer ..... H01C 1/142 338/272
5,907,274 A * 5/1999 Kimura ..... H01C 1/142 338/308
5,966,067 A * 10/1999 Murakami ..... H01C 1/142 338/307
2003/0117258 A1* 6/2003 Kim ..... H01C 1/142 338/309
2009/0108986 A1* 4/2009 Urano ..... H01C 1/012 338/309
2010/0039211 A1* 2/2010 Wang ..... B32B 38/0032 338/204
2012/0235782 A1 9/2012 Chen

FOREIGN PATENT DOCUMENTS

TW I234422 6/2005
TW I434299 B 4/2014

* cited by examiner

*Primary Examiner* — Kyung Lee
(74) *Attorney, Agent, or Firm* — Winston Hsu

(57) ABSTRACT

A micro-resistor includes a resistor material layer, an electrode set and a first protective layer. The electrode set includes a first electrode and a second electrode to define an opening which exposes the resistor material layer. A space between the first electrode and the second electrode represents an opening size. The first protective layer covers the opening completely and has a coverage size along a direction parallel with the space. The micro-resistor has a resistance of less than 5 milliohm and the difference of the opening size and the coverage size is less than 3100 micrometer to make the temperature coefficient of electrical resistance of the micro-resistor not greater than 150 ppm/° C.

20 Claims, 13 Drawing Sheets

MICRORESISTOR

CROSS REFERENCE TO RELATED APPLICATION

This application claims the benefit of Taiwanese Application 104123186, filed Jul. 17, 2015.

BACKGROUND OF THE INVENTION

1. Field of the Invention

The present invention is generally relates to a micro-resistor of small size. In particular, the present invention is directed to a small micro-resistor of particularly small temperature coefficient of electrical resistance so that products with such micro-resistor have a distribution of resistance as uniform as possible.

2. Description of the Prior Art

For the design of the current resistor pattern, the main features to design the resistor pattern are in accordance with the resistance demand to obtain the resistor pattern which meets the resistance demand. Usually, first the target resistance is confirmed before copper electrodes are formed at two end of the resistor pattern with the help of the lithographic and of copper-plating techniques. Later the resistance is fined-tuned by trimming the resistance so a resistor pattern of the target resistance is obtained.

SUMMARY OF THE INVENTION

The inventors found out that in the process of designing a resistor pattern, the prediction of positive or negative change of the temperature coefficient is too difficult so that the change of the resistance of a product is susceptible to the change of the temperature and it leads to the specification of the resistance of a product cannot be assured by the customers or by the end-users due to the great value of the temperature coefficient of electrical resistance of a product. Or the thickness distribution of the plated copper is not even enough to make the resistance of a product too much dispersed, to adversely affect the product yield, the trimming time and the integrity of the product so that the temperature coefficient of electrical resistance of the product is too dispersed to fall within a small range. The above problems all adversely affect the product quality of a micro-resistor.

In the light of the above, the present invention proposes a micro-resistor of particularly small temperature coefficient of electrical resistance. Such micro-resistor facilitates the even distribution of the temperature coefficient of electrical resistance of the product as much as possible in order to overcome the undesirable situations.

A micro-resistor includes at least a resistor material layer, an electrode set and a first protective layer. The electrode set includes a first electrode and a second electrode. Both are disposed on the same side of the resistor material layer to define an opening which exposes the resistor material layer. The space between the first electrode and the second electrode defines an opening size of the opening. The first protective layer covers the opening completely and has a coverage size along a direction parallel with the space. The micro-resistor has a resistance less than 5 milliohm and the difference of the opening size and the coverage size is less than 3100 micrometer so that the temperature coefficient of electrical resistance of the micro-resistor is not greater than 150 ppm/° C.

In one embodiment of the present invention, the first electrode includes a first plating electrode layer and a first electrode contact. The first plating electrode layer is in direct contact with the resistor material layer and disposed between the resistor material layer and the first electrode contact.

In another embodiment of the present invention, the first protective layer partially covers the first plating electrode layer but not in direct contact with the first electrode contact.

In another embodiment of the present invention, the micro-resistor further includes a solder part which covers the first electrode contact.

In another embodiment of the present invention, the second electrode includes a second plating electrode layer and a second electrode contact. The second plating electrode layer is in direct contact with the resistor material layer and disposed between the resistor material layer and the second electrode contact.

In another embodiment of the present invention, the first protective layer partially covers the second plating electrode layer but not in direct contact with the second electrode contact.

In another embodiment of the present invention, the micro-resistor further includes a solder part which covers the second electrode contact.

In another embodiment of the present invention, the micro-resistor further includes a substrate which directly connects the resistor material layer.

In another embodiment of the present invention, the difference is less than 1000 micrometer when the micro-resistor has a resistance less than 2 milliohm.

In another embodiment of the present invention, the difference is less than 700 micrometer so that the temperature coefficient of electrical resistance is not greater than 100 ppm/° C. when the micro-resistor has a resistance less than 1 milliohm.

In another embodiment of the present invention, the difference is less than 450 micrometer so that the temperature coefficient of electrical resistance is not greater than 100 ppm/° C. when the micro-resistor has a resistance less than 0.5 milliohm.

In another embodiment of the present invention, the temperature coefficient of electrical resistance is not greater than 60 ppm/° C. when the difference is less than 300 micrometer.

In another embodiment of the present invention, the temperature coefficient of electrical resistance is a value between 25° C.-125° C.

In another embodiment of the present invention, the resistor material layer is selected from a group consisting of MnCu alloy, NiCu alloy, CuMnSn alloy and NiCrAlSi alloy.

In another embodiment of the present invention, the micro-resistor further includes a heat-dissipating layer disposed on a side of the substrate and away from the resistor material layer.

In another embodiment of the present invention, the micro-resistor further includes a connecting layer attached to the heat-dissipating layer and extending from the heat-dissipating layer to the resistor material layer.

In another embodiment of the present invention, the micro-resistor further includes a second protective layer to cover the resistor material layer.

In another embodiment of the present invention, the micro-resistor further includes a third protective layer together with the heat-dissipating layer for capping the substrate and the third protective layer is connected to the heat-dissipating layer and to the substrate.

Considering different resistance ranges of micro-resistor products, the present invention correspondingly adjusts the difference of the opening size and the coverage size, preferably the difference is close to 0 as much as possible so that the temperature coefficient of electrical resistance of the micro-resistor is not greater than 150 ppm/° C. Preferably, the temperature coefficient of electrical resistance is advantageously not greater than 100 ppm/° C. when the difference is not greater than 300 micrometer to overcome the undesirable situations which the current micro-resistor products suffer.

These and other objectives of the present invention will no doubt become obvious to those of ordinary skill in the art after reading the following detailed description of the preferred embodiment that is illustrated in the various figures and drawings.

DETAILED DESCRIPTION

The present invention provides a micro-resistor of particularly small temperature coefficient of electrical resistance. Taken different resistance ranges of micro-resistors into consideration, the difference of the opening size and the coverage size is correspondingly adjusted, preferably the difference is not greater than 300 micrometer, so that different resistance of different micro-resistors may advantageously obtain the temperature coefficient of electrical resistance of the micro-resistor not greater than 100 ppm/° C. In such a way, a smaller temperature coefficient of electrical resistance inhibits the great fluctuation of the resistance due to the change of the temperature so that the distribution of the product resistance may be as even as possible. The temperature coefficient of electrical resistance is defined as follows:

$$\frac{R_2 - R_1}{R_1(T_2 - T_1)} 10^{-6} ppm/^\circ \text{ C.}$$

wherein $T_1$ is a lower first temperature,
$T_2$ is a higher second temperature,
$R_1$ is a resistance value at the first temperature,
$R_2$ is a resistance value at the second temperature.

Figure 1:
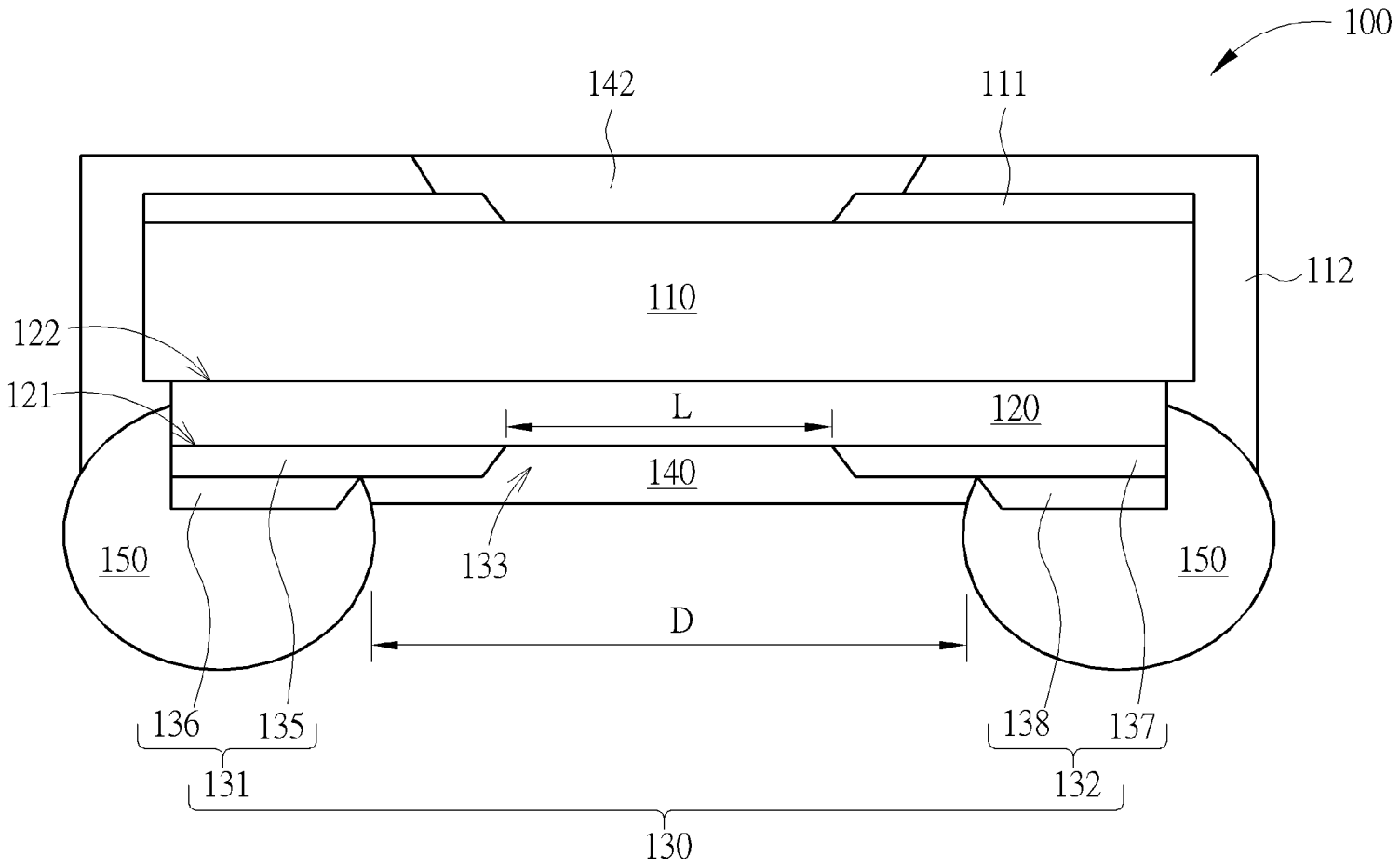
FIG. 1 illustrates a side cross-section of the micro-resistor of the present invention.
Figure 1A:
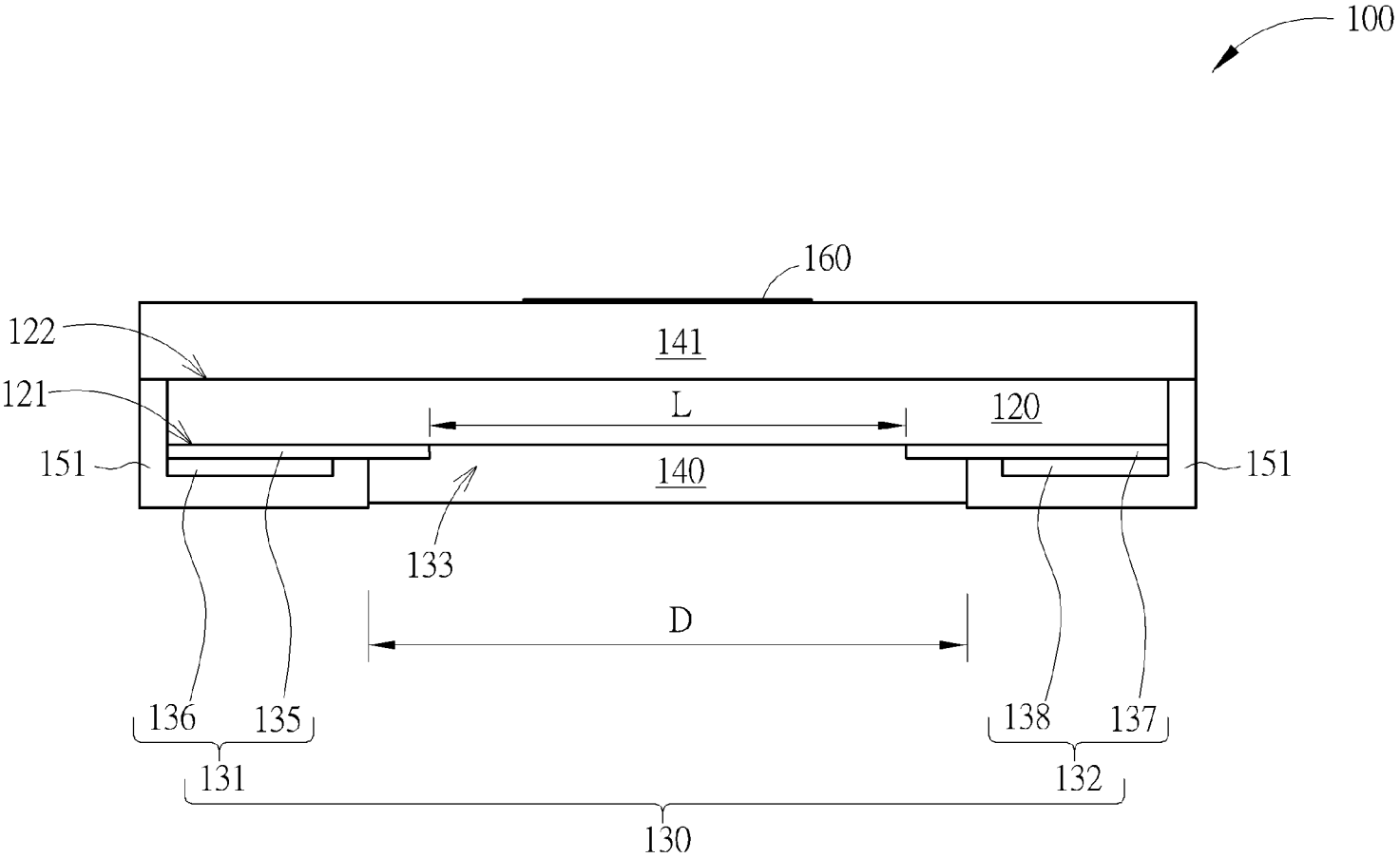
FIG. 1A illustrates a side cross-section of another embodiment of the micro-resistor of the present invention without a substrate but with a second protective layer and a marking.
Figure 1B:
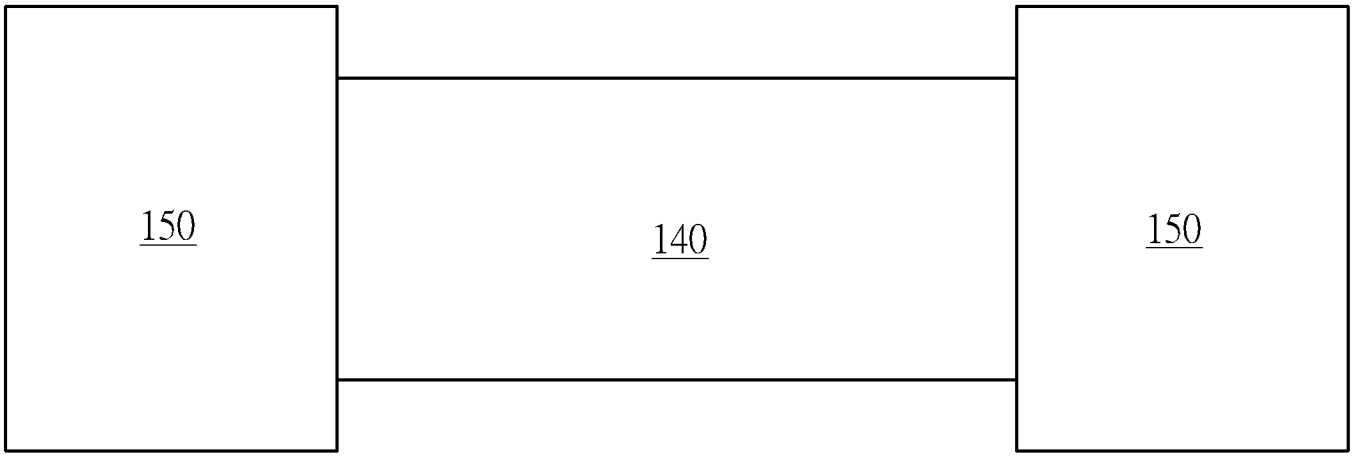
FIG. 1B illustrates a bottom view of FIG. 1.

Please refer to FIG. 1. It illustrates a side cross-section of the micro-resistor of the present invention. As shown in FIG. 1, the micro-resistor 100 of the present invention includes an optional substrate 110, an optional heat-dissipating layer 111, an optional connecting layer 112, a resistor material layer 120, an electrode set 130, a first protective layer 140 and a solder part. The substrate 110 may has a material such as aluminum oxide or aluminum nitride. The resistor material layer 120 is disposed on the substrate 110 which is used for support and directly connected to the substrate 110. The resistor material layer 120 has a first side 121 opposite to a second side 122. Further the resistor material layer 120 is disposed on and within the substrate 110 so the rim of the resistor material layer 120 is surround by the margin of the substrate 110. The first protective layer 140 may has a material such as fiber glass or polyimide. FIG. 1A illustrates a side cross-section of another embodiment of the micro-resistor of the present invention; the substrate is omitted and a second protective layer 141 and a marking 160 are introduced. The second protective layer 141 covers the second side 122 of the resistor material layer 120. The marking 160 denotes the product or the serial number and is optional. FIG. 1B illustrates a bottom view of FIG. 1.

The resistor material layer 120 usually has an alloy material, such as MnCu alloy, NiCu alloy, CuMnSn alloy or NiCrAlSi alloy . . . etc. Generally speaking, the thickness of the resistor material layer 120 may be 0.025 mm-0.3 mm. The electrode set 130 is disposed on the same side as the resistor material layer 120 is, for example the electrode set 130 is disposed on the first side 121 of the resistor material layer 120.

Table 1 shows different temperature coefficients of resistance of different alloy materials between the temperature range 20° C.-105° C. From Table 1 it is observed that the temperature coefficient of electrical resistance of the pure copper material is by far greater than that of the alloy materials.

TABLE 1

| | ingredients (%) | | | | | | | | TCR (ppm/° C.) | μΩ-cm |
|---|---|---|---|---|---|---|---|---|---|---|
| Composition | Cu | Ni | Cr | Mn | Fe | Al | Sn | Si | 20° C.~105° C. | (20° C.) |
| CuNi | remnant | 44 | — | 1 | — | — | — | — | −80~+40 | 49 |
| CuMnNi | remnant | 2 | — | 12 | — | — | — | — | ±50 | 43 |
| CuMnSn | remnant | — | — | 7 | — | — | 2.3 | — | ±10 | 29 |

TABLE 1-continued

| Composition | ingredients (%) | | | | | | | | TCR (ppm/° C.) | μΩ-cm |
|---|---|---|---|---|---|---|---|---|---|---|
| | Cu | Ni | Cr | Mn | Fe | Al | Sn | Si | 20° C.~105° C. | (20° C.) |
| NiCrAlSi | — | remnant | 20 | 0.5 | 0.5 | 3.5 | — | 1 | ±50 | 132 |
| copper electrode | — | — | — | — | — | — | — | — | 3860 | |
| annealed copper electrode | — | — | — | — | — | — | — | — | 3930 | |
| CuMn | remnant | | | 3 | | | | | 280~380 | 12.5 |

Please refer to FIG. 1, the electrode set 130 includes a first electrode 131 and a second electrode 132 in pair. The first electrode 131 and the second electrode 132 are disposed on the same side of the resistor material layer 120 but they are not in direct contact with each other. Because the first electrode 131 and the second electrode 132 are not in direct contact with each other, an opening 133 is formed between them to expose some of the resistor material layer 120. The first electrode 131 and the second electrode 132 which are not in direct contact with each other have specific space between them. The specific space defines an opening size L of the opening 133. In addition, in one embodiment of the present invention, the heat-dissipating layer 111 may extend from the margin of the substrate 110 to be connected to the first electrode 131 and/or the second electrode 132.

In one embodiment of the present invention, the first electrode 131 includes a first plating electrode layer 135 and a first electrode contact 136, preferably the first plating electrode layer 135, the first electrode contact 136 and the resistor material layer 120 collectively form a steps-like structure, as shown in FIG. 1. The first plating electrode layer 135 is disposed on the resistor material layer 120 and in direct contact with the resistor material layer 120. The first electrode contact 136 is disposed on the first plating electrode layer 135 but is slightly shorter than the first plating electrode layer 135 along the direction of the opening size L so the first plating electrode layer 135 is disposed between the resistor material layer 120 and the first electrode contact 136.

Similarly, the second electrode 132 includes a second plating electrode layer 137 and a second electrode contact 138, preferably the second plating electrode layer 137, the second electrode contact 138 and the resistor material layer 120 collectively form a steps-like structure. The second plating electrode layer 137 is disposed on the resistor material layer 120 and in direct contact with the resistor material layer 120. The second electrode contact 138 is disposed on the second plating electrode layer 137 but is slightly shorter than the second plating electrode layer 137 along the direction of the opening size L so the second plating electrode layer 137 is disposed between the resistor material layer 120 and the second electrode contact 138. In one embodiment of the present invention, the first plating electrode layer 135, the first electrode contact 136, the second plating electrode layer 137 and the second electrode contact 138 may have tapered side surfaces.

Preferably, both the first electrode 131 and the second electrode 132 are of copper material. In other words, the first plating electrode layer 135, the first electrode contact 136, the second plating electrode layer 137 and the second electrode contact 138 are preferably made of copper. The pure copper material is known to have relatively large temperature coefficient of electrical resistance, for example about 3860 ppm/° C. for pure copper material and about 3930 ppm/° C. for annealed copper material. When in use, the electric current flows from one of the first electrode 131 and the second electrode 132 of the micro-resistor 100 into the resistor material layer 120 and leaves the micro-resistor 100 from still one of the first electrode 131 and the second electrode 132.

Because opening 133 exposes some of the resistor material layer 120, a first protective layer 140 is needed to keep the exposed resistor material layer 120 from outside damage. The first protective layer 140 may be a solder mask material to completely cover the opening 133. For example, methods such as printing laminating, heat pressing, spraying, electro-plating may be used to apply the solder mask material onto the opening 133 and resultantly to make the solder mask material solidified. Due to the natural reason of the printing application, the solder mask material may also be applied onto the first electrode 131 and onto the second electrode 132 which define the opening 133 in addition to the location of the opening 133. Accordingly, the first protective layer 140 would more or less cover the first electrode 131 and the second electrode 132. However, ideally speaking, the first protective layer 140 may possibly not cover the first electrode 131 and the second electrode 132. Optionally, there may be a third protective layer 142 together with the heat-dissipating layer 111 to cap the substrate 110 so that the third protective layer 142 is connected to the heat-dissipating layer 111 and to the substrate 110 to keep the substrate 110 from oxidation.

Figure 2:
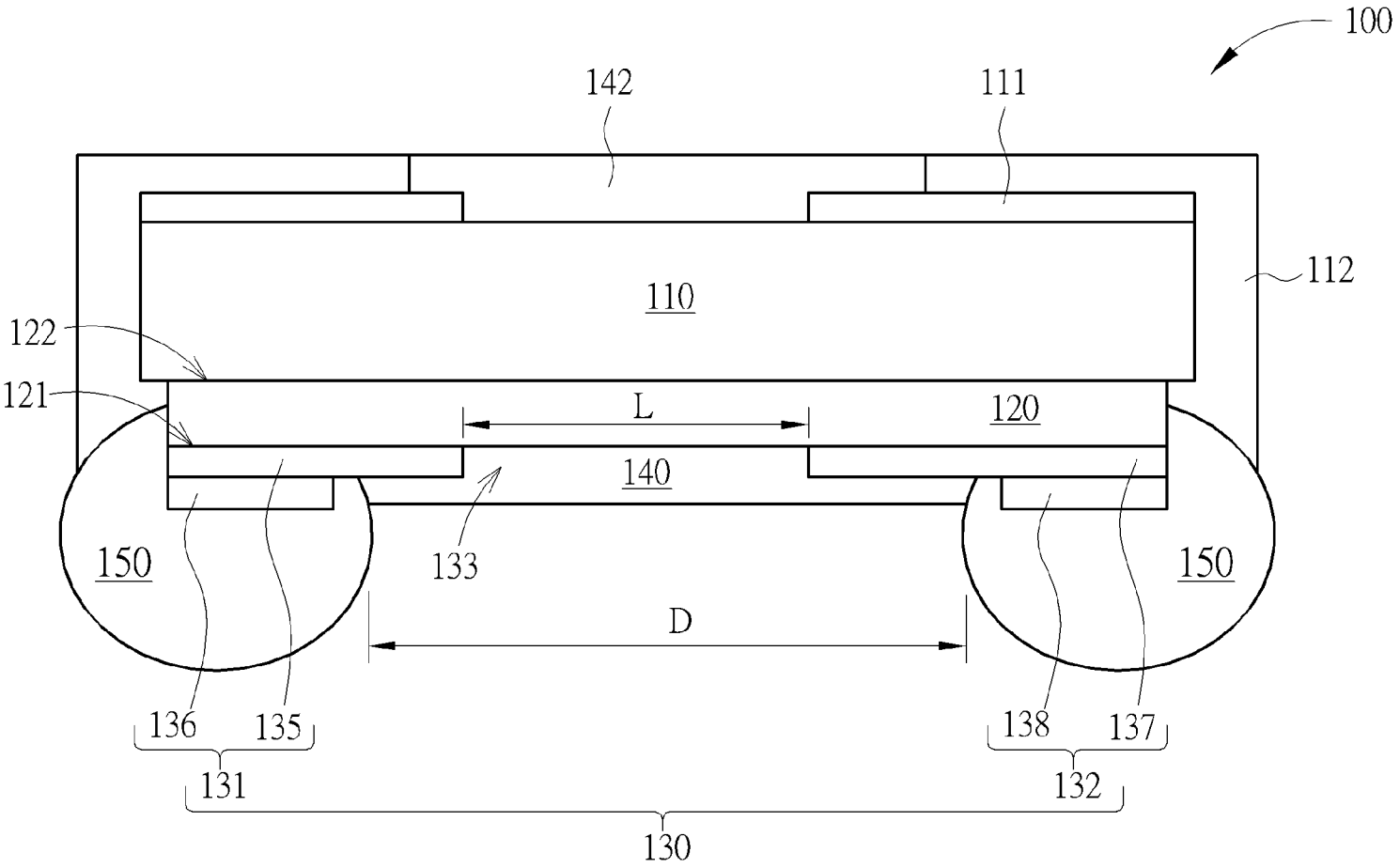
FIG. 2 illustrates the first protective layer does not symmetrically cover the opening.
Figure 2A:
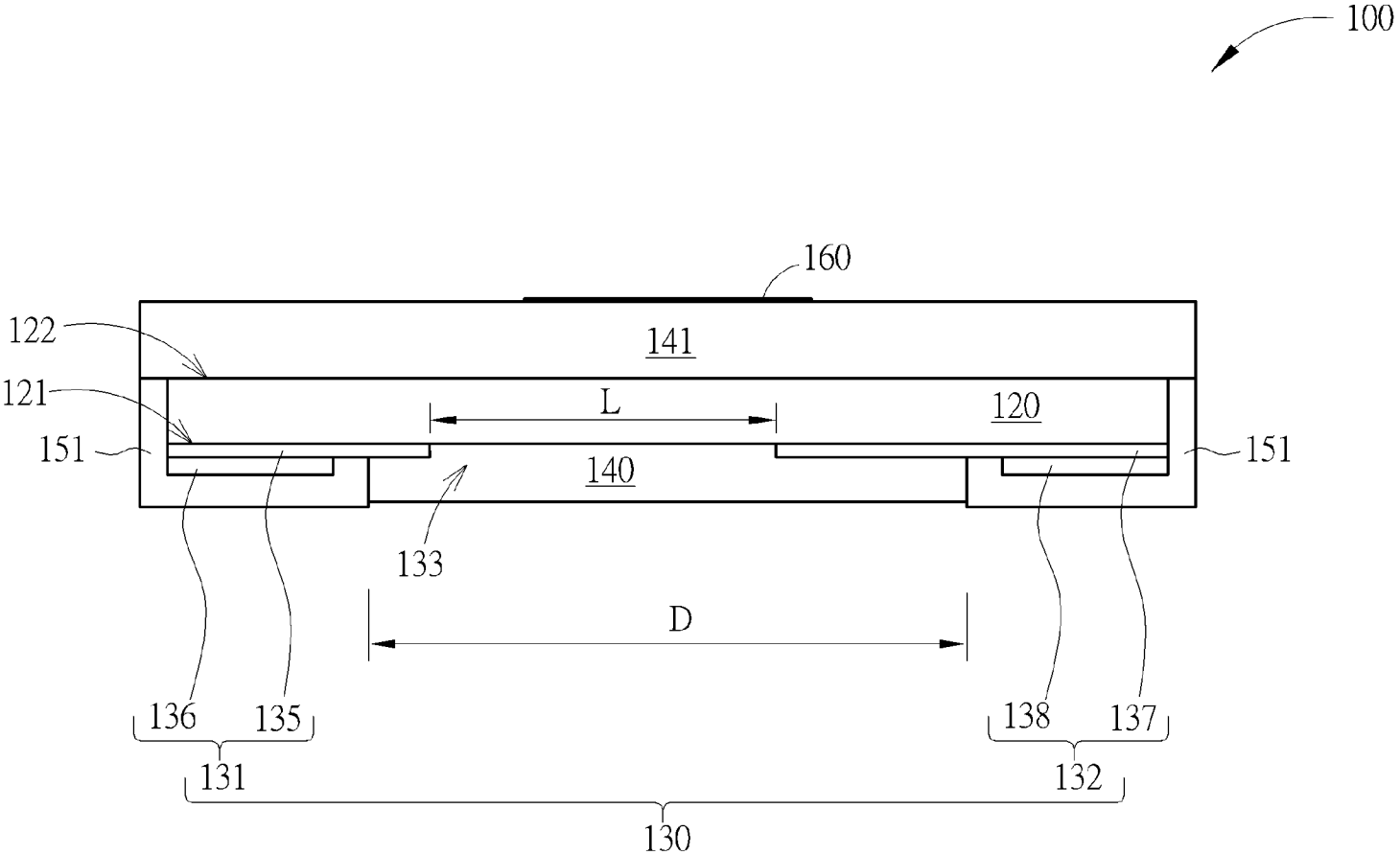
FIG. 2A illustrates the first protective layer does not symmetrically cover the opening without a substrate and with a second protective layer and the marking.

As shown in FIG. 1, the size which makes the first protective layer 140 cover the opening 133, the first electrode 131 and the second electrode 132 is called a coverage size D. The coverage size D represents a length size D which is the first protective layer 140 parallel with the direction along the space so the size which makes the first protective layer 140 cover the first electrode 131 and the second electrode 132 is the difference D-L of the coverage size D and the opening size L. Please notice that, as shown in FIG. 2, the first protective layer 140 would not necessarily cover the opening 133 in a symmetrical way so the size which corresponds to the first protective layer 140 covering the first electrode 131 may not necessarily equal to the size which corresponds to the first protective layer 140 covering the second electrode 132. The size which corresponds to the first protective layer 140 covering the first electrode 131 may be optionally more or less. FIG. 2A illustrates the first protective layer 140 would not necessarily cover the opening 133 in a symmetrical way, the substrate is omitted and the second protective layer 141 and the marking 160 both are present. However, no matter the first protective layer 140 symmetrically covers the opening 133 or not, the total size which the first protective layer 140 covers the first electrode 131 and the second electrode 132 is the difference D-L. In another embodiment of the present invention, the first plating electrode layer 135, the first electrode contact 136, the second plating electrode layer 137 and the second electrode contact 138 may have vertical side surfaces.

Figure 3:
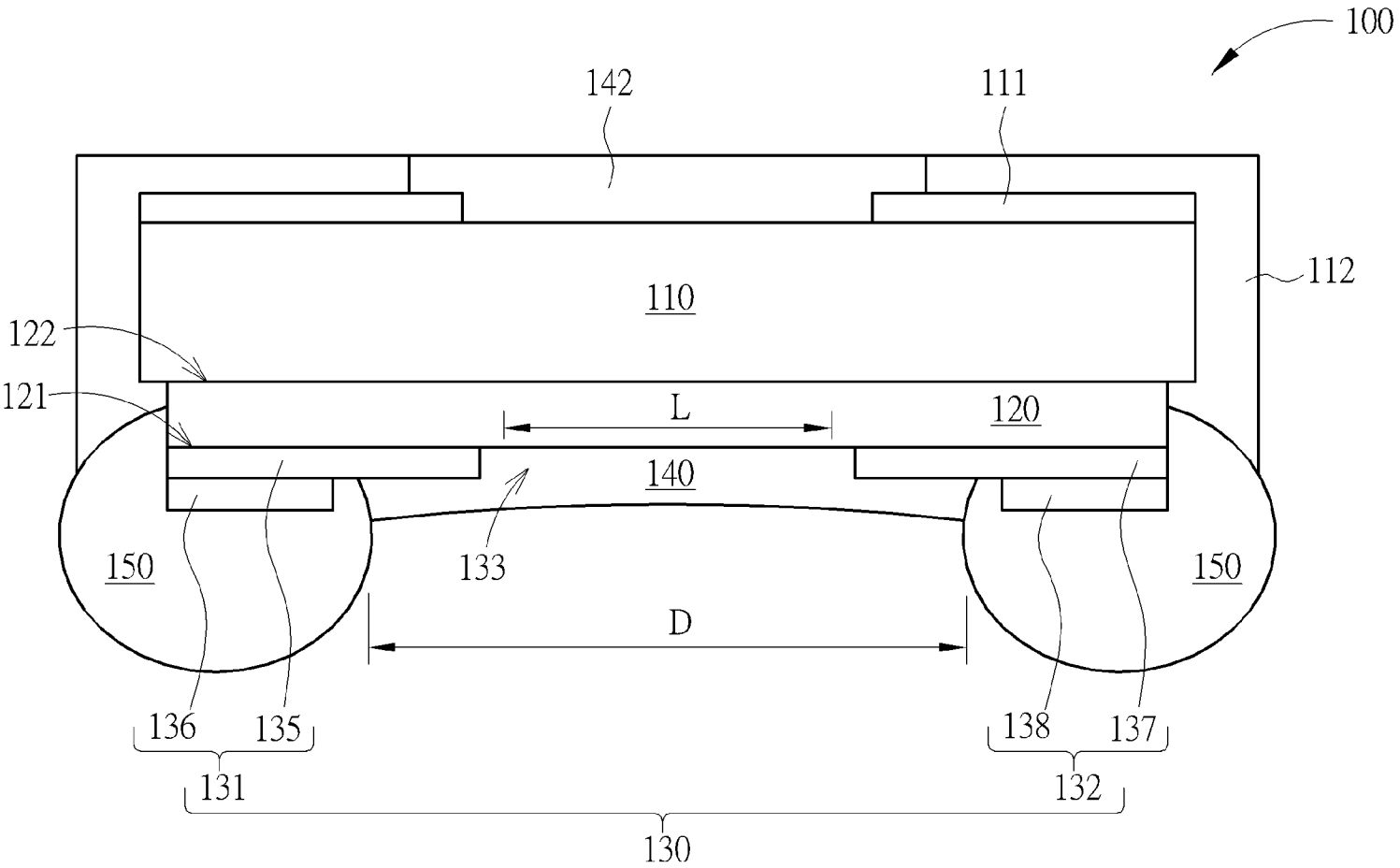
FIG. 3 illustrates the first protective layer is recessed to cover the opening.
Figure 3A:
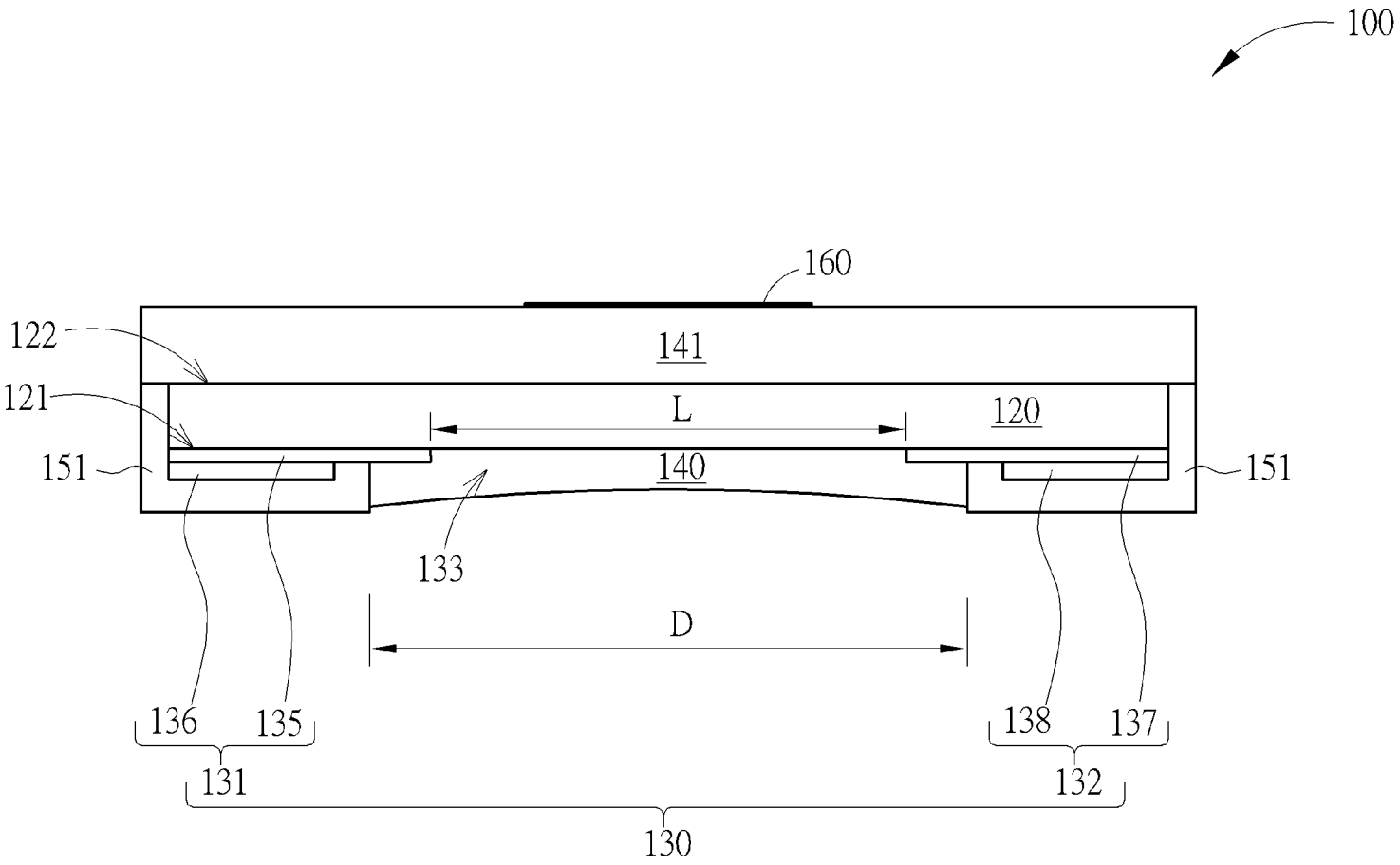
FIG. 3A illustrates the first protective layer is recessed to cover the opening without the substrate but with the second protective layer along with the marking.
Figure 4:
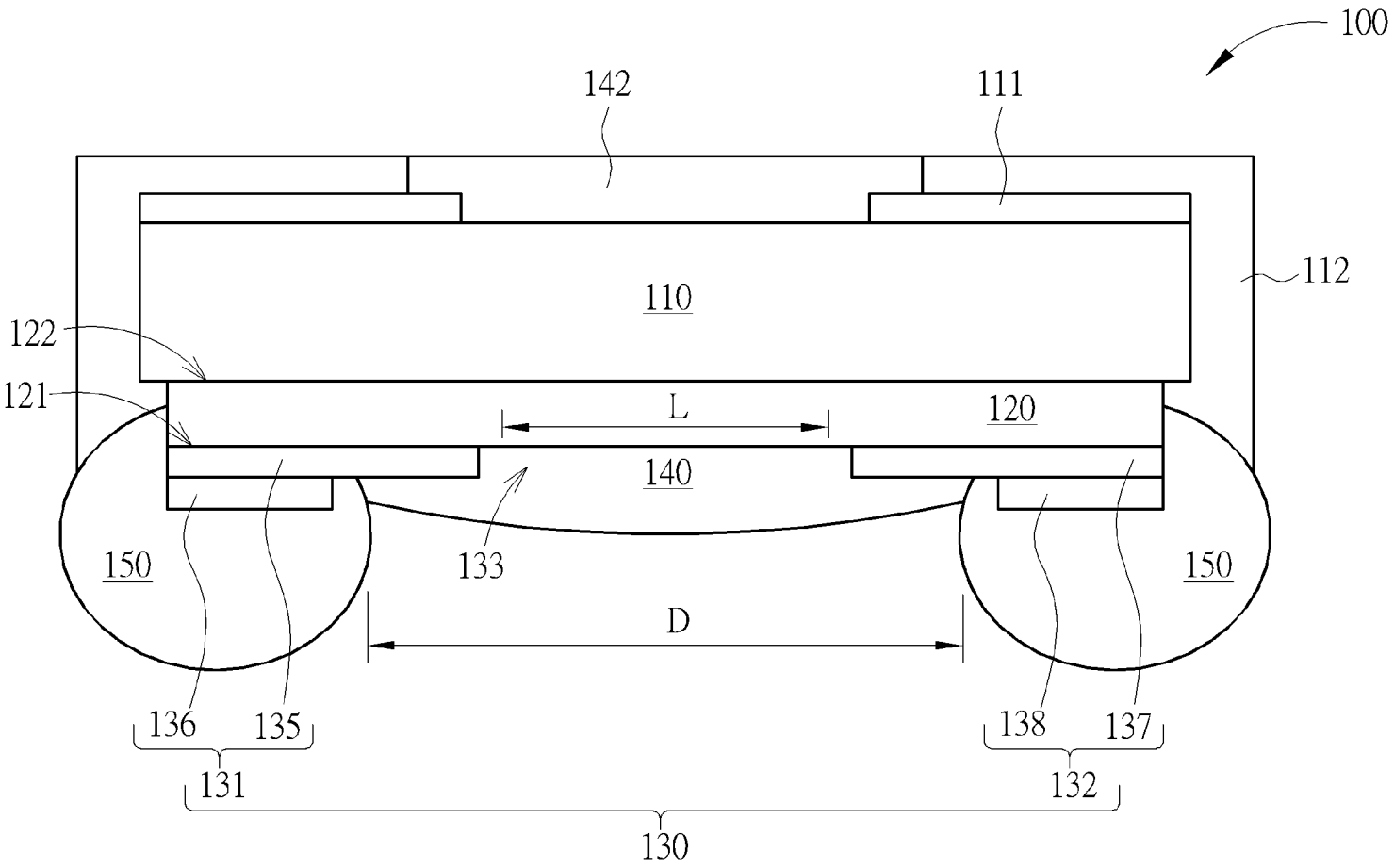
FIG. 4 illustrates the first protective layer covers the opening in a bulging way.
Figure 4A:
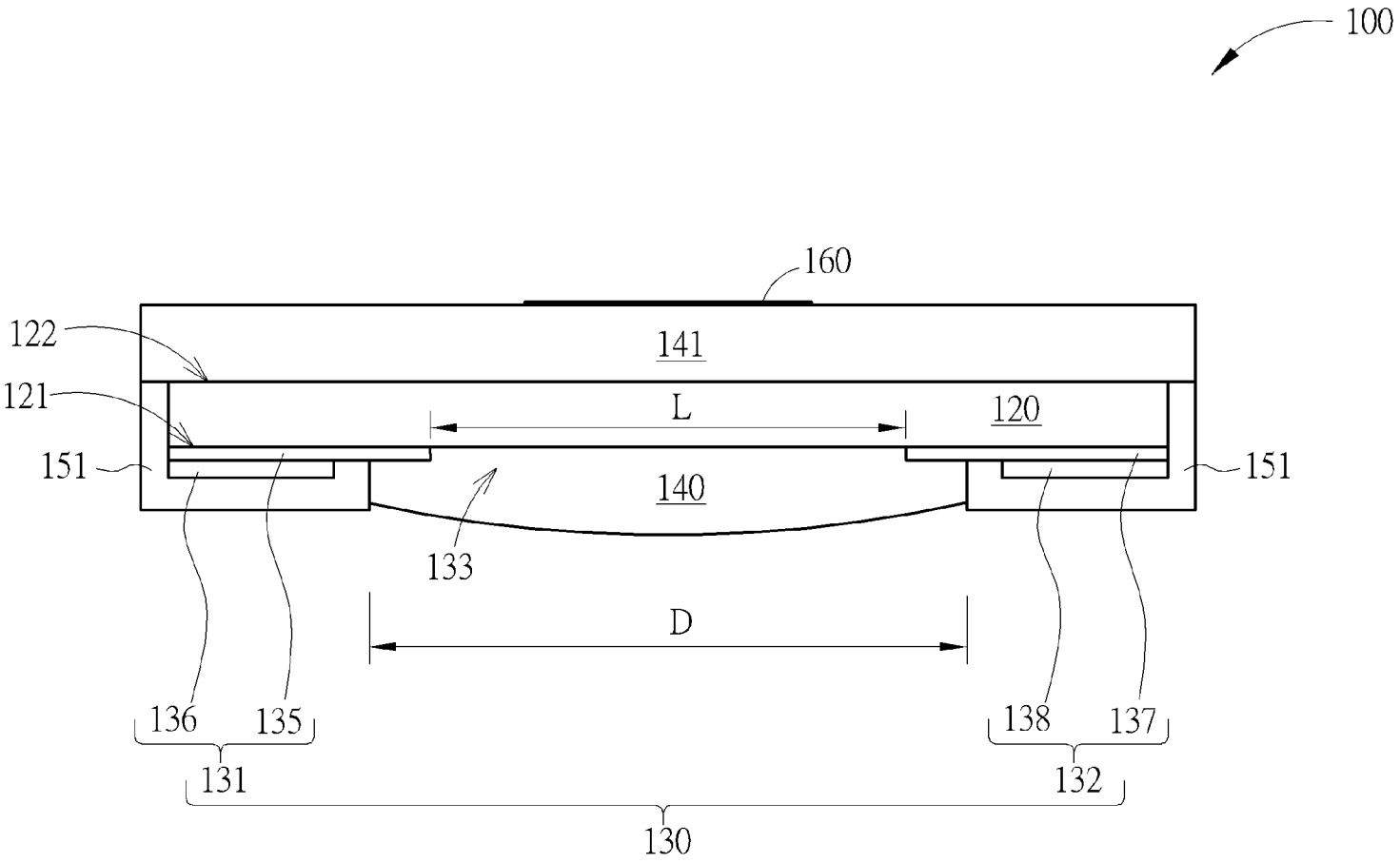
FIG. 4A illustrates the first protective layer covers the opening in a bulging way without the substrate but with the second protective layer along with the marking.

The first protective layer 140 may cover the opening 133 in various possible ways but the first protective layer 140 covers the opening 133 with the coverage size D, or further covers some of the first electrode 131 and the second electrode 132. As shown in FIG. 1, the first protective layer 140 may cover the opening 133 in a horizontal way. FIG. 1A illustrates the first protective layer 140 covers the opening 133 in a horizontal way without the substrate but with the second protective layer 141 along with the marking 160. As shown in FIG. 3, the first protective layer 140 may be recessed to cover the opening 133. FIG. 3A illustrates the first protective layer 140 is recessed to cover the opening 133 without the substrate but with the second protective layer 141 along with the marking 160. As shown in FIG. 4, the first protective layer 140 covers the opening 133 in a bulging way. FIG. 4A illustrates the first protective layer 140 covers the opening 133 in a bulging way without the substrate but with the second protective layer 141 along with the marking 160.

Figure 5:
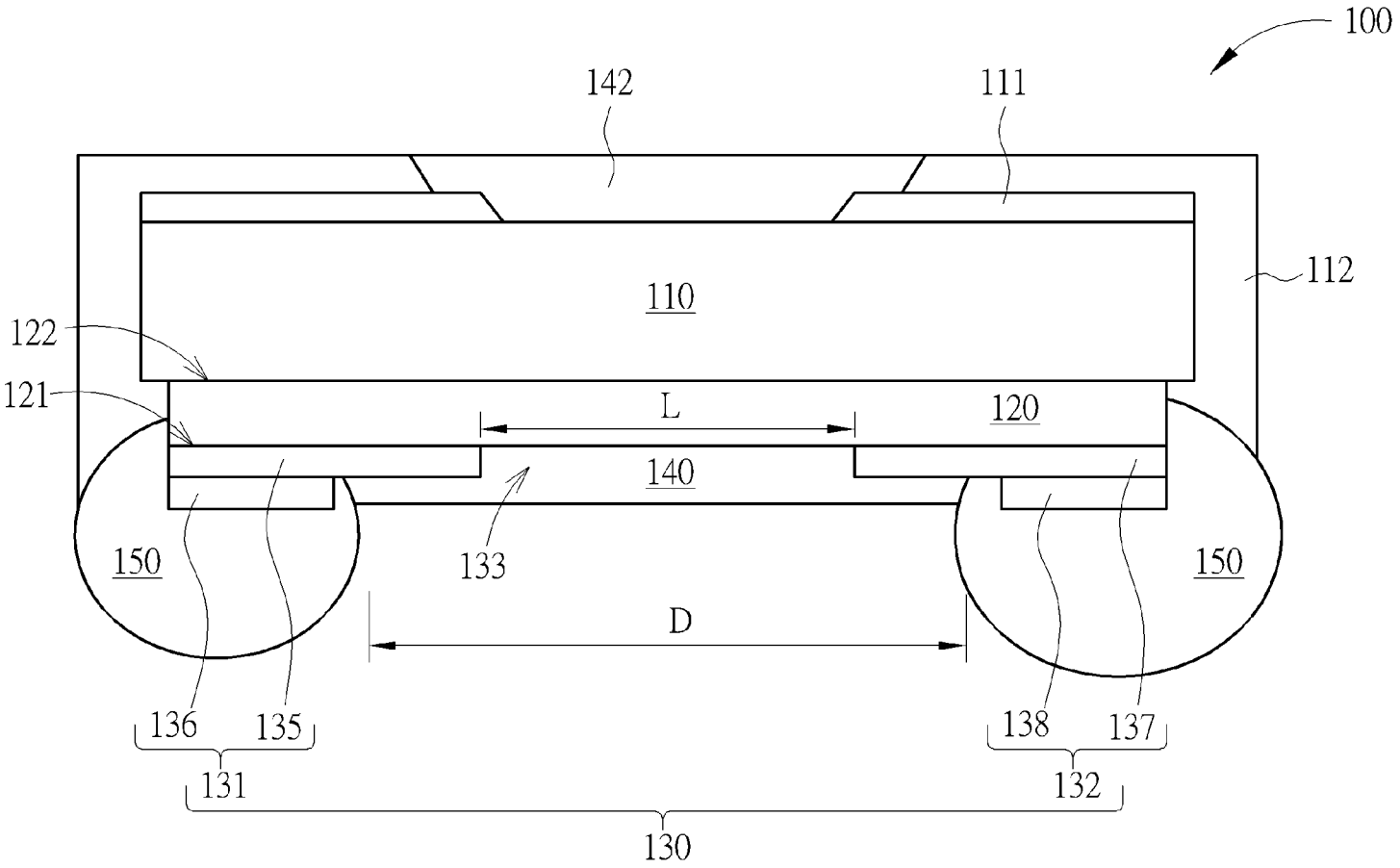
FIG. 5 illustrates the solder part unsymmetrically covers the first electrode and the second electrode.
Figure 5A:
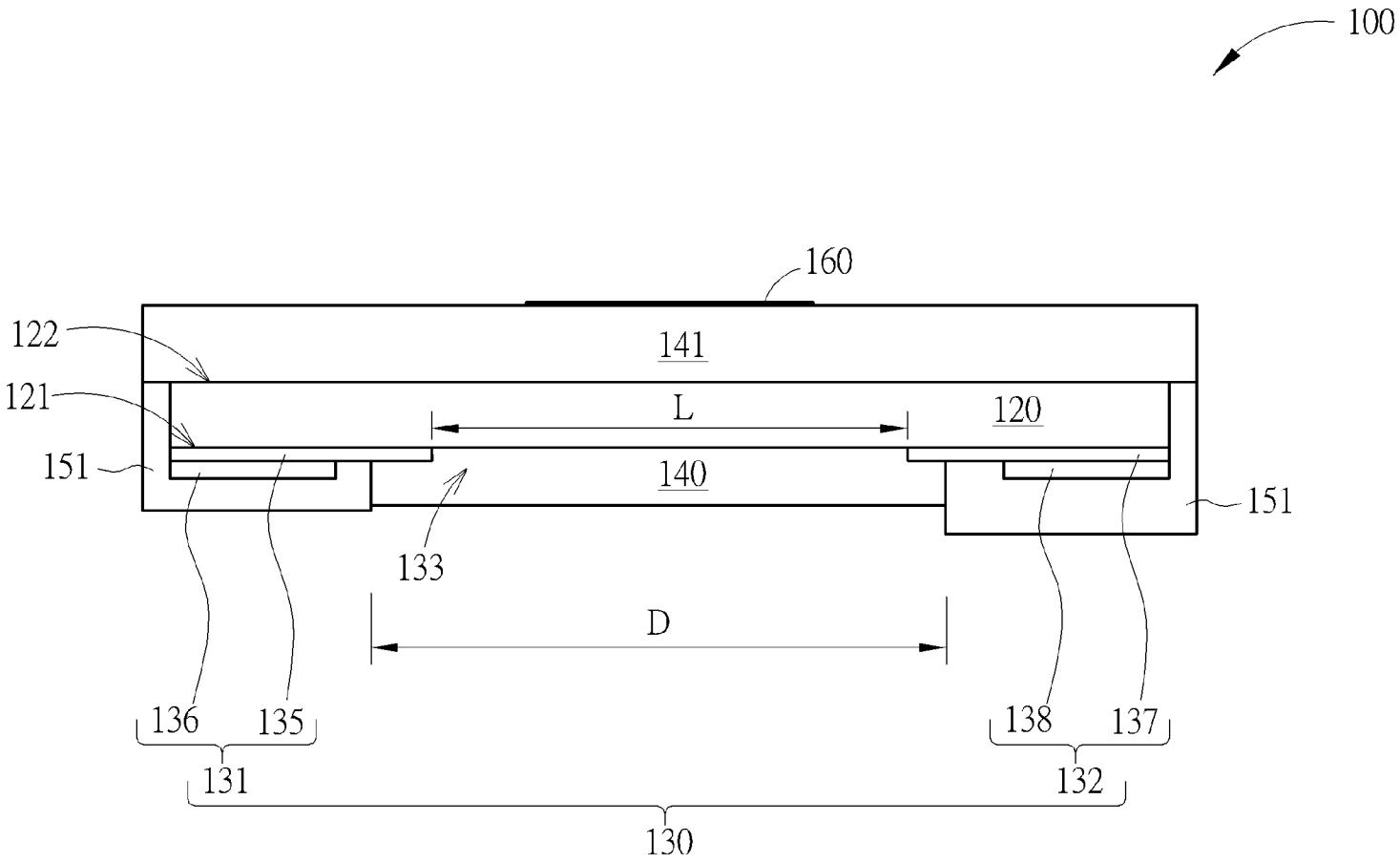
FIG. 5A illustrates that the solder layer unsymmetrically covers the first electrode or the second electrode without the substrate but with the second protective layer along with the marking.

Optionally, the micro-resistor 100 may further include a solder part. The solder part may have various shapes and a solder ball 150 or a solder layer 151 is given here as an example but is not limited to these. The solder part may be used to protect at least one of the first electrode 131 and the second electrode 132. For example, the solder part may cover the first electrode contact 136, or the solder part may further cover the second electrode contact 138. Or as shown in FIG. 5, the solder ball 150 may not be necessarily placed over the first electrode 131 or the second electrode 132 in a symmetrical way so the first protective layer 140 may not necessarily cover the opening 133 in a symmetrical way. FIG. 5A illustrates that the solder layer 151 covers the first electrode 131 or the second electrode 132 in an unsymmetrical way without the substrate but with the second protective layer 141 along with the marking 160. In another embodiment of the present invention, the first protective layer 140 may partially cover the first plating electrode layer 135. When the solder ball 150 or the solder layer 151 serving as a solder part covers the first electrode contact 136, it makes the first protective layer 140 not in direct contact with the first electrode contact 136. Similarly, the first protective layer 140 may partially cover the second plating electrode layer 137. For example, when the solder ball 150 or the solder layer 151 serving as a solder part covers the second electrode contact 138, it makes the first protective layer 140 not able to directly contact the second electrode contact 138. The solder part may include Sn, a solder alloy or silver. Also in FIG. 5, the optional connecting layer 112 may be connected to the heat-dissipating layer 111 and extend from the heat-dissipating layer 111 to the resistor material layer 120 to help the micro-resistor 100 to be connected to the solder part. The connecting layer 112 may include a metal material, such as Ni or Sn.

The inventors found out that the temperature coefficient of electrical resistance of the micro-resistor may be advantageously not greater than 150 ppm/° C. when the micro-resistor 110 has a resistance not greater than 5 milliohm if the difference D-L of the coverage size D and the opening size L is less than 3100 micrometer. Preferably, the difference D-L is less than 1000 micrometer when the micro-resistor has a resistance less than 2 milliohm. In one embodiment of the present invention, the difference is less than 700 micrometer so that the temperature coefficient of electrical resistance may be not greater than 100 ppm/° C. when the micro-resistor has a resistance less than 1 milliohm. In another embodiment of the present invention, the difference is less than 450 micrometer so that the temperature coefficient of electrical resistance may be not greater than 100 ppm/° C. when the micro-resistor has a resistance less than 0.5 milliohm. More preferably, the temperature coefficient of electrical resistance may be not greater than 60 ppm/° C. when the difference is less than 300 micrometer. The temperature coefficient of electrical resistance in the present invention is an example of a range from room temperature to an elevated temperature, for instance the temperature coefficient of electrical resistance between 25° C.-125° C.

Table 2 shows the results of the difference D-L of the coverage size D and the opening size L, and the resistance difference of different resistance values between 25° C.-125° C. To be explained in advance, 1) the resistance difference $\Delta R$ is $R_2-R_1$; 2) $T_1$ is the first temperature at 25° C.; 3) $T_2$ is the second temperature at 125° C. as an example but it is not restricted to these conditions. In practice, $T_2-T_1 \leq 100°$ C. is workable. For example, $T_1$ may also be 30° C. and $T_2$ may be 130° C., or $T_1$ may be 30° C. and $T_2$ may be 60° C. An alloy material $Cu_{0.907}Mn_{0.07}Sn_{0.023}$ is used in Table 2 to serve as the resistor material layer 120. The dimension of the resistor material layer 120 is 3.2 mm×6.4 mm. The coverage size D is changeable but the opening size L is kept unchanged so that there are various differences D-L present in each group.

TABLE 2

| Group | D—L (micro meter) | ΔR | Electrical resistance of micro-resistor (milliohm) | | | | | | | | |
|---|---|---|---|---|---|---|---|---|---|---|---|
| | | | 0.5 | 0.75 | 1 | 1.5 | 2 | 2.5 | 3 | 4 | 5 |
| | | | Corresponding temperature coefficient of electrical resistance | | | | | | | | |
| 1 | 300 | 0.003 | 60 | 40 | 30 | 20 | 15 | 12 | 10 | 8 | 6 |
| 2 | 1000 | 0.02 | 400 | 267 | 200 | 133 | 100 | 80 | 67 | 50 | 40 |
| 3 | 1700 | 0.035 | 700 | 467 | 350 | 233 | 175 | 140 | 117 | 88 | 70 |
| 4 | 2400 | 0.053 | 1060 | 707 | 530 | 353 | 265 | 212 | 177 | 133 | 106 |
| 5 | 3100 | 0.071 | 1420 | 947 | 710 | 473 | 355 | 284 | 237 | 178 | 142 |

Figure 6:
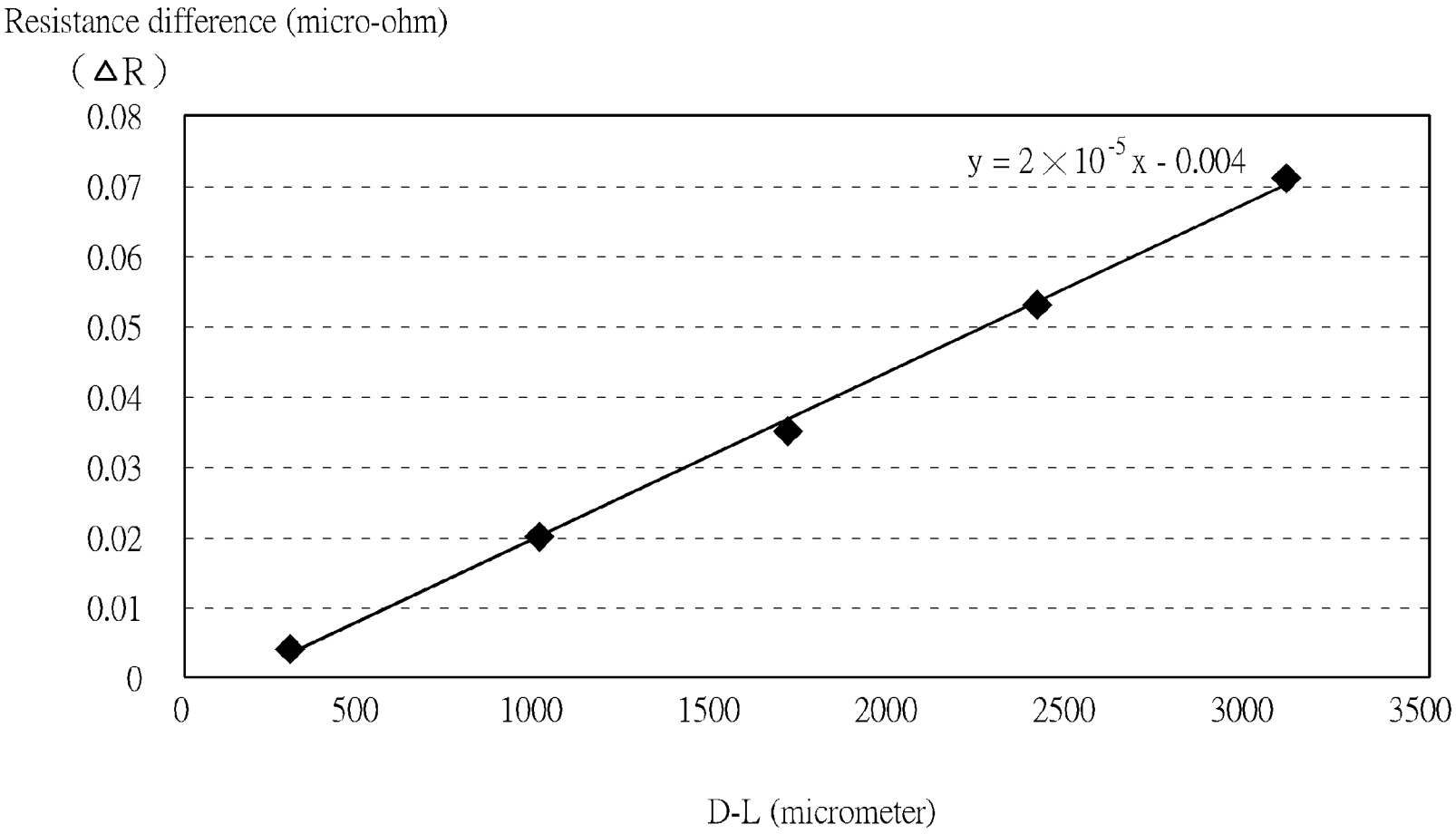
FIG. 6 illustrates various differences D-L and the corresponding resistance differences ΔR.

FIG. 6 illustrates various differences D-L and the corresponding resistance differences $\Delta R$. The regression equation obtained by the mathematical regression analysis is $y=2\times10^{-5}x-0.004$. By observation FIG. 6, it is found that various differences D-L and the corresponding resistance differences $\Delta R$ show good linear relationship with respect to the regression equation obtained by the mathematical regression analysis. The calculated correlation coefficient is 0.999458 to conform an excellent linear relationship.

Figure 7:
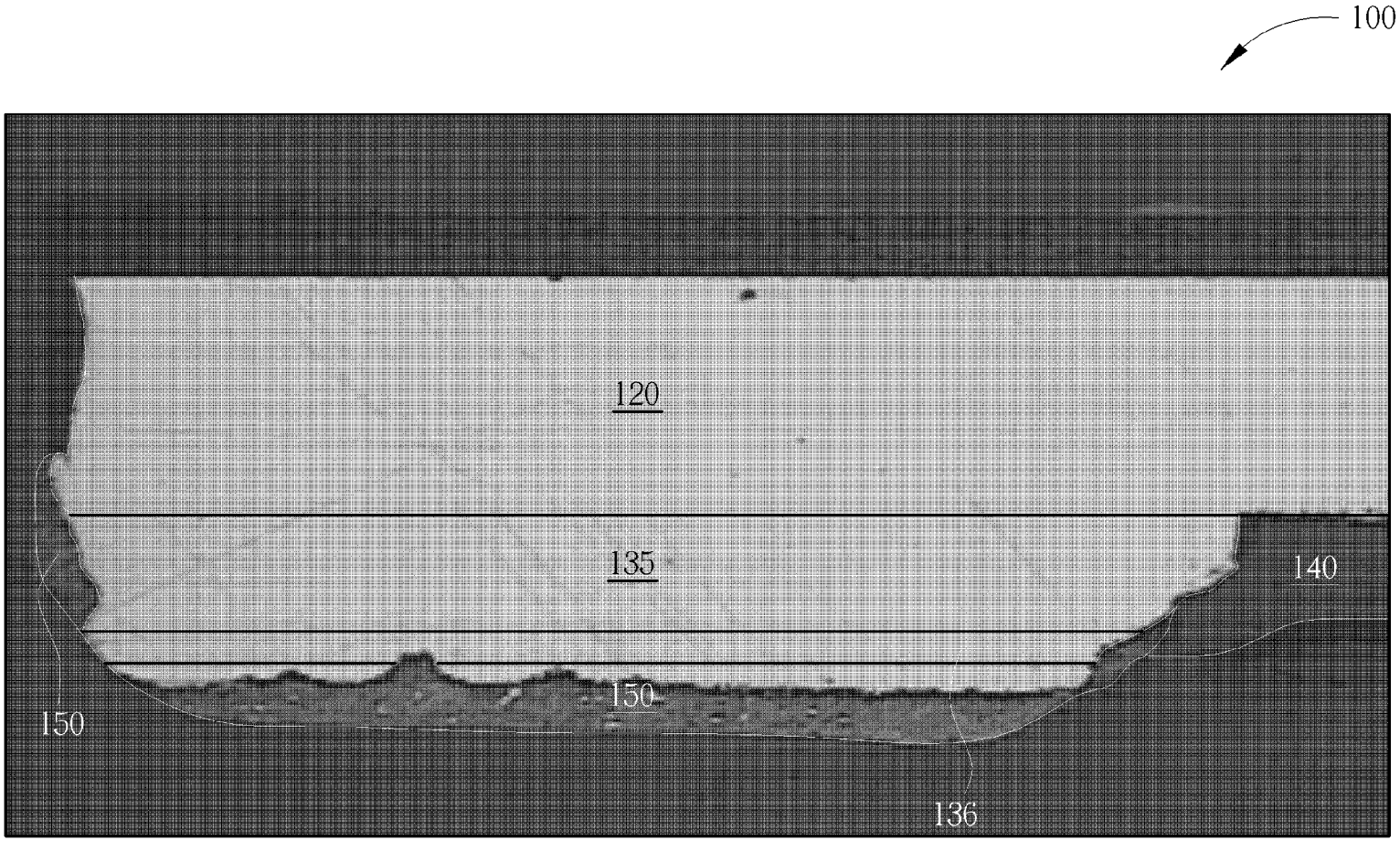
FIG. 7 illustrates partial enlargement of the micro-resistor of the present invention.

FIG. 7 illustrates partial enlargement of the micro-resistor 100 of the present invention. As shown in FIG. 7, in the micro-resistor 100 of the present invention the first protective layer 140 covers the resistor material layer 120. The first plating electrode layer 135, the first electrode contact 136 and the resistor material layer 120 together form a steps-like structure. In addition, the solder ball 150 of the solder part blocks the first protective layer 140 to directly contact the first electrode contact 136.

Because the present invention takes different resistance ranges of micro-resistor products into consideration, the difference of the opening size and the coverage size is correspondingly adjusted, preferably the difference is as close to 0 as possible, so that the temperature coefficient of electrical resistance of the micro-resistor is not greater than 150 ppm/° C. Preferably, the temperature coefficient of electrical resistance is advantageously not greater than 100 ppm/° C. when the difference is not greater than 300 micrometer.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A micro-resistor, comprising:

a resistor material layer;

an electrode set comprising a first electrode and a second electrode, both disposed on the same side of said resistor material layer to define an opening which exposes said resistor material layer and space between said first electrode and said second electrode defining an opening size of said opening; and a first protective layer to cover said opening completely and having a coverage size along a direction parallel with said space, wherein said micro-resistor has an electrical resistance less than 5 milliohm and the difference of said opening size and said coverage size is less than 3100 micrometer to make the temperature coefficient of electrical resistance of said micro-resistor not greater than 150 ppm/° C.

2. The micro-resistor of claim 1, wherein said first electrode comprises a first plating electrode layer and a first electrode contact and said first plating electrode layer is in direct contact with said resistor material layer and disposed between said resistor material layer and said first electrode contact.

3. The micro-resistor of claim 2, wherein said first protective layer partially covers said first plating electrode layer without directly contacting said first electrode contact.

4. The micro-resistor of claim 2 further comprising:

a solder part to cover said first electrode contact.

5. The micro-resistor of claim 1, wherein said second electrode comprises a second plating electrode layer and a second electrode contact and said second plating electrode layer is in direct contact with said resistor material layer and disposed between said resistor material layer and said second electrode contact.

6. The micro-resistor of claim 5, wherein said first protective layer partially covers said second plating electrode layer without directly contacting said second electrode contact.

7. The micro-resistor of claim 5 further comprising:

a solder part to cover said second electrode contact.

8. The micro-resistor of claim 1 further comprising:

a substrate to directly connect said resistor material layer.

9. The micro-resistor of claim 8 having a resistance less than 2 milliohm and the difference is less than 1000 micrometer.

10. The micro-resistor of claim 8 further comprising:

a heat-dissipating layer disposed on a side of said substrate and away from said resistor material layer.

11. The micro-resistor of claim 10 further comprising:

a connecting layer attached to said heat-dissipating layer and extending from said heat-dissipating layer to said resistor material layer.

12. The micro-resistor of claim 10 further comprising:

a third protective layer together with said heat-dissipating layer for capping said substrate and said third protective layer is connected to said heat-dissipating layer and to said substrate.

13. The micro-resistor of claim 1 having a resistance less than 1 milliohm.

14. The micro-resistor of claim 13, wherein the difference is less than 700 micrometer and the temperature coefficient of electrical resistance is not greater than 100 ppm/° C.

15. The micro-resistor of claim 1 having a resistance less than 0.5 milliohm.

16. The micro-resistor of claim 15, wherein the difference is less than 450 micrometer and the temperature coefficient of electrical resistance is not greater than 100 ppm/° C.

17. The micro-resistor of claim 1, wherein the difference is less than 300 micrometer so that the temperature coefficient of electrical resistance is not greater than 60 ppm/° C.

18. The micro-resistor of claim 1, wherein the temperature coefficient of electrical resistance is a value between 25° C.-125° C.

19. The micro-resistor of claim 1, wherein said resistor material layer is selected from a group consisting of MnCu alloy, NiCu alloy, CuMnSn alloy and NiCrAlSi alloy.

20. The micro-resistor of claim 1 further comprising:

a second protective layer to cover said resistor material layer.

* * * * *